US005480250A

United States Patent [19]

Birden

[11] Patent Number: 5,480,250

[45] Date of Patent: Jan. 2, 1996

[54] DISPENSER WITH RIGID OPEN PORE NIB

[76] Inventor: Donald Birden, 444 N. Lamon, Chicago, Ill. 60644-2027

[21] Appl. No.: 225,300

[22] Filed: Apr. 8, 1994

[51] Int. Cl.[6] ..... B43K 8/02; B43K 8/12

[52] U.S. Cl. ..... 401/199; 401/198

[58] Field of Search ..... 401/199, 198

[56] References Cited

U.S. PATENT DOCUMENTS

| | | | |
|---|---|---|---|
| 2,204,203 | 6/1940 | Zimmerman . | |
| 3,230,574 | 1/1966 | Kershaw . | |
| 3,449,054 | 6/1969 | Lundsager . | |
| 3,609,052 | 9/1971 | Airosus | 401/199 |
| 3,628,876 | 12/1971 | Casey et al. . | |
| 3,881,828 | 5/1975 | Jones . | |
| 3,942,903 | 3/1976 | Dickey et al. . | |
| 4,043,682 | 8/1977 | McDaniel et al. | 401/199 |
| 4,336,767 | 6/1982 | Wada . | |
| 4,408,921 | 10/1983 | Nagai . | |
| 4,568,214 | 2/1986 | Kawaguchi et al. . | |
| 4,923,317 | 5/1990 | Bishop et al. | 401/199 X |
| 4,927,695 | 5/1990 | Ooms et al. | 428/159 |
| 5,299,877 | 4/1994 | Birden | 401/206 |
| 5,324,127 | 6/1994 | Cortez | 401/202 X |
| 5,395,444 | 3/1995 | Arndt et al. | 118/31.5 |
| 5,400,067 | 3/1995 | Day | 347/87 |

FOREIGN PATENT DOCUMENTS

| | | | |
|---|---|---|---|
| 1561844 | 4/1970 | Germany | 401/198 |
| 8505344 | 12/1985 | WIPO | 401/199 |
| 9221448 | 10/1992 | WIPO | 401/206 |

*Primary Examiner*—Steven A. Bratlie
*Attorney, Agent, or Firm*—Clyde I. Coughenour

[57] ABSTRACT

A porous dispenser for typewriter white-out, coloring, microcapsules and other coating materials is made with a relatively rigid open cell foam nib. The foam has an average of from 12 to 25 pores per linear centimeter with an average pore size from 0.4 to 2 microns. The nib rigidity can be provided by a hard material nib or by having a flexible porous foam material compressed from its original volume to from 1/10th to 1/20th its original volume. The nib has less than a 20% compression when subjected to a 400 gm/cm$^2$pressure. The nib can be used with a pigmented coating material, microcapsules or polish with an average particle size of from 0.4 to 1 micron.

20 Claims, 1 Drawing Sheet

DISPENSER WITH RIGID OPEN PORE NIB

CROSS-REFERENCE

This application is related to applicant's prior application, Ser. No. 08/012,920 filed Feb. 3, 1993 and now U.S. Pat. No. 5,299,877, issued Apr. 5, 1994, which was a continuation-in-part of applicant's Ser. No. 07/798,148 filed Nov. 26, 1991.

BACKGROUND OF THE INVENTION

1. Field of the Invention

This invention relates to coating applicators or, dispensers, such as for the application of typewriter white-out, coloring, cosmetics for make-up, anti-perspirants, deodorants, medications, touch-ups, swabs, polish to shoes, etc. They can dispense liquids, particles or micro-capsules in suspension. The applicator or dispenser has a shaped open pore wicking nib for controllably transferring fluid coating material to the surface of an object to be coated. Because of the relative stability of the nib, small or narrow areas can be coated even though they are adjacent areas that are not to be coated or that are, for example, of different colors.

2. Description of Related Art

Present coating applicators, such as brush type typewriter white-out, felt type and capillary type markers and shoe polish applicators, etc., are designed for cover-up, marking and the care of shoes that are of one color. They are designed to yield so that curved surfaces and hard to reach areas can be contacted by the readily deformable wicking pad. The applicator of the patent issued 15 Sep. 1964 to J. R. Gilchrist et al., U.S. Pat. No. 3,148,401, is representative of the type that have a soft, readily deformable foam or fabric pad for wicking the liquid polish from a supply container and spreading the polish onto a surface such as a shoe. The pads are generally made of a polyurethane or other sponge with a large open cell configuration or of a felt material. When pressed against a shoe to release the polish, the pad surface engages the shoe and deforms so that its shape and dimensions are significantly altered to conform to the shape of the surface area being coated.

A problem with liquid applicators using soft foam wicking application pads is that the compacted foam often becomes so thin that its wicking characteristics are significantly altered; the compressed foam often becomes permanently compacted; and as the liquid of the polish dries and solidifies in the pad, the pad becomes a hardened mass that is incapable of conforming to the contours of the shoe. Frequently, on hardening, the pad clogs and will no longer permit the passage of the coating material or polish. Another problem is that soft foam is prone to being worn or scraped off during use. This usually results in an uneven application or puddling of the coating on the surface. When multi-color shoes or other surfaces with irregular patterns are coated, adjacent surface areas are routinely inadvertently coated also.

Nib pens are quite popular. The use of white color nib dispensers has not been as popular because they are not as effective as other color dispensers. Liquid coatings and solid films having white pigments and frangible white films are routinely used to coat or cover over smudges and mistakes such as typing errors. The liquid coatings are typically applied by a brush means and solid films are typically applied by impacting a carrier to transfer a frangible white film on the carrier. The pigmented liquids are routinely stored in containers that are closed by a threaded cap that is attached to the brush or applicator. The removal of the cap to use the applicator admits air into the container and the air ultimately results in the premature solidification of the pigmented liquid within the container. This problem is similar to that experienced with some shoe polish applicators. Also, the brush applicators do not permit controlled dispensing of the width nor the location of application desired. The pigmented films are difficult to position and usually require the same key to be used to correct the error that was used to make the error. The primary reason white nib pens have not been used with pigmented materials is that the carriers dry out and the pigments clog the small or porous passageways. It has unexpectedly been discovered that a small pore compressed foam can be used to dispense a pigment containing liquid. In view of this, pigmented liquid coating materials can be dispensed through a narrow porous shaped nib. By use of the appropriate pigment carrier, it has unexpectedly been found that the nib will neither clog nor permanently dry out.

U.S. Pat. No. 4,925,327, issued 15 May 1990 to D. Wirt, teaches a liquid applicator with a supply and open cell elastomer foam sponge. The foam is given a permanent compression set with a reduction in its original volume of from 1.5 to 10. A reduction in volume of ½to ¼its original volume is preferred. The sponge has from 10 to 100 pores per linear inch with 90 pores per inch preferred. A layer of porous unfoamed material is used to meter the liquid from the supply to the sponge applicator. The combination is designed or selected so that the liquid will wet but not drip, the storage capacity (density) of the sponge will be regulated to hold the amount of liquid to be dispensed, and to control or adjust the viscosity and the surface tension of the liquid to be dispensed.

The use of nib dispensers is common in the art. The dispensers are used for marking, cosmetics, medications, etc. The nibs are commonly made from felt, fibers and extrusions. some nibs have been made by sintering or foaming. The word "foam" is frequently misused. It is often used as a substitute for the generic word "porous."

Foams have been in use to dispense solid particles for some time. Zimmerman, U.S. Pat. No. 2,204,263, issued 11 Jun. 1940, is one example of a powder cosmetic applicator. Porous nibs made by sintering are taught by Casey et al, U.S. Pat. No. 3,628,876, issued 21 Dec. 1971, and Dickey et al, U.S. Pat. No. 3,942,903, issued 9 Mar. 1976. The nibs can be made hard to resist wear with Jones, U.S. Pat. No. 3,881,828, issued 6 May 1975, one example. Lundsager, U.S. Pat. No. 3,449,954, issued 10 Jun. 1969, teaches the use of a fine foam. It is well known that a sheath, repellant coating casing, covering or sleeve can be used over a thin or frangible nib to lend support and that the reservoir can be provided with a porous ink saturated tampon, fibers, wick or absorbant core material with U.S. Pat. No. 4,408,921, issued 11 Oct. 1983, an example. Reservoirs are generally formed from a plastic, metal or other material into a fluid container. The nib is sealed within an opening in the container with evaporation prevented by a friction fit, snap fit, or threaded cap. Foams in general are discussed further in applicant's aforementioned parent, U. S. Pat. No. 5,299,877, issued 15 April 1994.

There has been a general assumption that large pores were necessary to conduct the coating, and in particular a pigment containing coating material, through a porous applicator pad. Even with the use of large pores, there has been a problem with the pads hardening and preventing the free flow of the coating material through the pad.

SUMMARY OF THE INVENTION

The principal objective of the present invention is to accurately control the application of the liquid or coating fluid material. This is accomplished by providing a nib with relatively small open pores that do not significantly deform when pressed against a surface to be coated or polished. The applicator, and in particular a corner or edge of the nib, can be used in a manner similar to that of a capillary marking pen. Unlike the capillary pen where fluid flow is restricted to linear flow in the direction of the linear capillary channels, the fluid can flow in any direction within the nib.

The applicator has a nib of predetermined thickness and rigidity or firmness which is sufficiently resistent to deformation that the nib thickness is not significantly altered as the nib is placed on and forced against a surface to be coated. The nib can be made completely or partially from a relatively rigid foam material or can be a compressed reticulated foam. The foam can, for example, be an open pore flexible ester polyurethane foam with a controlled foam pore size and firmness. Because the nib does not significantly deform, the coating can be controlled both as to the amount of material applied and the location where the material is applied. As one example, a narrow strip of material can be coated without application of the coating material to adjacent areas. A line that is very narrow or relatively wide can be drawn by use of the nib corner or wedge side edge.

The trend for application of coatings that contain solid pigments has been to use nib applicators that are resilient with large pores. It has been discovered that by using a coating material with reasonably controlled particle size and nib pore size, with a minimum clearance between the particles and pores, the coating can be applied by capillary action similar to that used for liquid transfer in pens and other implements. In addition, by making the nib rigid, the applicator maintains the pore size, even under normal use pressures, and maintains uniform coating characteristics that are similar to those of capillary flow pens.

The relatively rigid open pore nib provides for relatively constant multiple cross-section passages from the container reservoir to the coating surface. The control of the pore size forming the passages provides for capillary flow of the coating material through the nib and provides a controllable ratio between particles in the coating fluid and passage cross-section and also provides a metering and almost constant flow of coating material through the nib without the need for a separate or additional metering means. The flow of coating material remains essentially constant because of the relatively non-compressible nature of the nib.

Because of the multiple relatively constant small cross-section flow through the nib, the response time required for the coating material to travel through the nib depends on the nib length. The shorter the nib, the less time required for travel through the nib length. The small amount that the nib does bend can be controlled in part by the exposed length and/or hardness or resistance to bending of the nib material and pre-use compression. A support in the form of a sheath, casing, sleeve, or cover can be pressed over the nib or can be coated or extruded over the nib.

The nib can be frictionally held in its support, or it can be used with a side seal, when the nib and support are of a different shape, or the nib can be provided with a repellant coating or a resilient sheath along its length to prevent discharge along the side of the nib, from accidental contact, and to act as a seal or gasket and resilient holding means between the nib and reservoir nib support.

In one use of the invention, the coating material or polishing liquid in the container or reservoir can include a pigment. One composition that can be used is acrylic copolymer D, hydroxy, alcohol, organic amine neutralizer, titanium dioxide pigment and water. For use with such a pigmented coating material, the nib must have pores with a diameter large enough to facilitate passage of the pigments and liquid therethrough. This combination enables the nib to be used as a typewriter white-out means or as a white coloring means or dispenser of microcapsules or as a shoe polish means.

DETAILED DESCRIPTION OF THE PREFERRED EMBODIMENT

Figure 1:
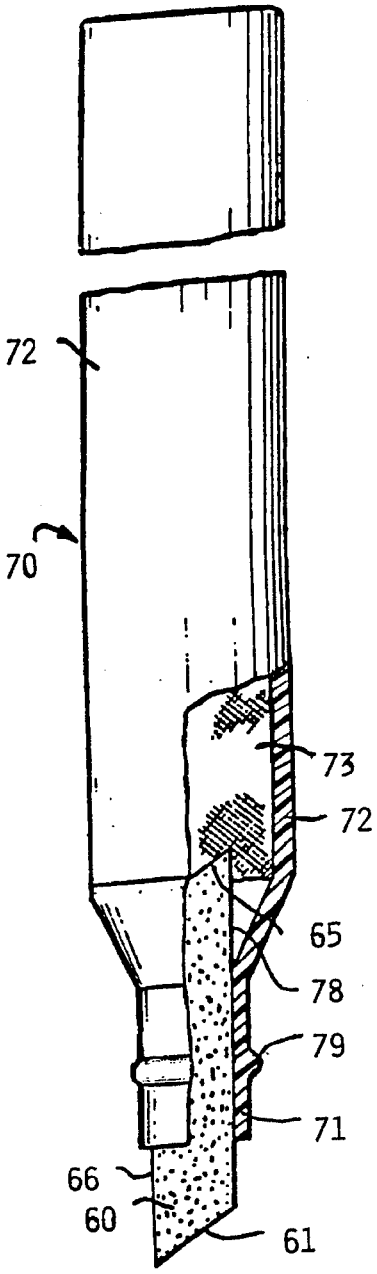
FIG. 1 is a fragmentary cross-sectional view showing a rectangular cross-sectional porous nib held in a coating material dispenser.
Figure 2:
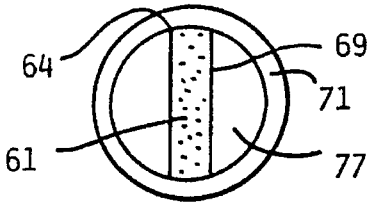
FIG. 2 is essentially an end view of FIG. 1 looking toward the nib.

FIG. 1 shows a typical hand-held felt-type nib applicator or container 70 having a reservoir 72 for holding a supply of coating material. The applicator or container 70 has a neck nib support end section 71 providing a passage for a nib 60, that extends from within the reservoir 72 through the neck support 71 to outside the container. The nib support 71 and nib 60 provide a passage for the coating material from the reservoir to the surface to be coated. The nib is shown with a common wedge-shaped proximal end 61 and an angled distal end 65. The coating material enters the nib through the pores at the distal end and distal sides 78, that extended into the reservoir. The reservoir nib support 71 is provided with protrusions 79 on the outer side that fit within recesses 91 in a cap 90 to seal the nib 66 from the outside when not in use. The reservoir 72 is shown having a tampon or porous, absorbant coating and distribution material 73 within the reservoir. FIGS. 1 and 2 show a rectangular cross-section nib 60 held in a circular container 70. The coating material can be discharged from the nib 60 in a thin line, from a corner 64, or in a thick line from a proximal side edge 69 or nib side 66.

FIG. 2 is essentially an end of FIG. 1 looking into the nib 66. When a rectangular cross-section nib is used with a circular cross-section container, a nib side seal material 77 can be used to prevent coating material leakage. The nib can be retained in the support by a force fit with the nib or by a plastic or rubber material or by an adhesive.

Figure 3:
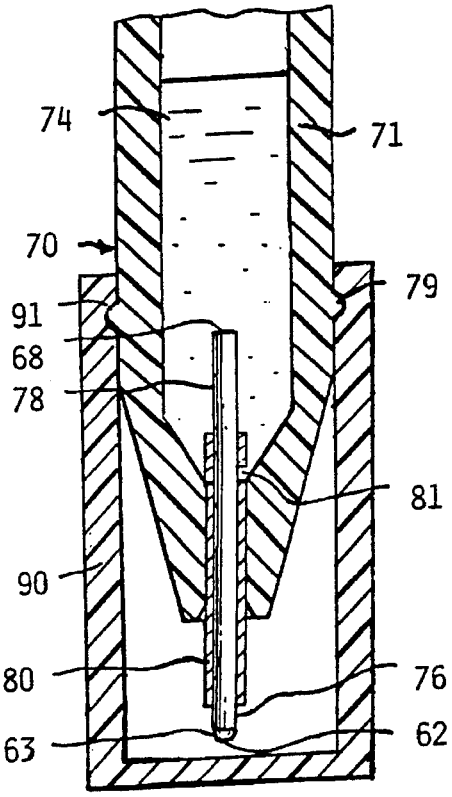
FIG. 3 is a fragmentary cross-section view showing a coated or supported cylindrical cross-sectional porous nib held in a coating material dispenser.

FIG. 3 is a view similar to FIG. 1, having a container 70 with a reservoir 72, nib support 71 and snap protrusion 79; however, there is no porous reservoir distribution material 73. A cylindrical nib is provided with a blunt distal end 68 and a proximal end having a blunt circular area 62 at the end of a tapered section 63 extending from a nib side area 76. While not always necessary, a covering or sheath 80 is provided over a portion of the extent of the nib sides 76. The sheath 80 can be repellant and resilient to prevent accidental discharge of coating material from the sides of the nib and can act as a gasket and holding means between the nib and nib support 71. The coating material 74 enters the nib at the distal end 68 and sides 78 that extend into the reservoir 72. The container and nib can be held so as to coat from the proximal end 62 or taper 63 or side 76 of the nib. To be able to use all of the coating material in the reservoir 72, the sheath 80 can be terminated at or before it reaches the reservoir proper or openings 81 can be made in the sheath to permit the coating material to enter the nib at or near the intersection of the sheath and reservoir proper. As an alternative, the sheath 80 can be of a rigid metal or plastic that gives support to a small cross-sectional porous nib used to make thin lines of the coating material. The sheath can be placed over the porous nib by pressing, dipping, extrusion or other process. Any convenient holding or sealing means can be used between the nib and sheath and/or between the sheath and support, if necessary. The porous nib can be permanently attached to the support by adhesive, heating or other means.

Figure 4:
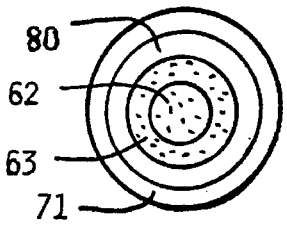
FIG. 4 is essentially an end view of FIG. 3 looking toward the nib.

FIG. 4 is essentially an end view of FIG. 3 looking into the nib showing the blunt end 62 and taper 63 of the nib.

Figure 5:
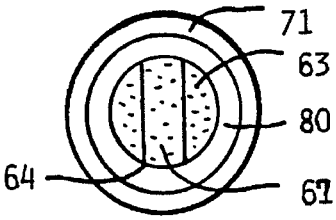
FIG. 5 is essentially an end view similar to FIG. 4 looking toward the nib showing a taper that forms a rectangular proximal end.

The nib proximal end can take any shape desired. The shape is chosen to give the desired coating configuration. FIG. 5 shows a cylindrical nib, similar to that of FIGS. 2 and 4 with the proximal end having flat tapers 63 that form a rectangular blunt proximal end If a dye material is used, the capillary attraction or adhesive attraction between the coating material and nib material is of primary importance. If a pigment is included in the coating fluid, the size of the pigments and passage openings within the nib become a primary consideration. For a given coating and nib material and nib length, the time required for the coating material to progress from the reservoir to the nib proximal end 61, 62 varies. For optimum performance, the rigidity of the nib, the pore size of the nib and the coating material must be coordinated.

An important aspect of the present invention is the pore size of the nib and the pore size relationship to the coating material, and in particular the particle size of any pigments used in the coating material. Surprisingly, it has been found that if a capillary relationship is maintained between the pore size and coating material, not only are desirable coating characteristics provided, but even the dreaded dryout and hardening or blockage occurring during non-use of the applicator is overcome to some degree. While not fully understood, it is believed that drying out is retarded or that the capillary action assists in liquid contact and rewetting of the particles that, because of the close tolerances between the pore or opening size and particles, does not permit the particles and dried coating material to form an aggregate or large rigid body of particles bonded together by the coating material that is intended to be formed on the surface to be coated.

The nib can be made of compressed, reticulated "open pore" flexible ester type polyurethane foam. The nib must have pores of sufficient size to allow the coating material or polish or microcapsules to properly wick. If the pores are too small, the coating material will clog up the pores of the nib, stop the migration of the coating material through the nib, and prevent it from reaching the proximal end of the nib. On the other hand, if the pores are too large, the polish will flow too quickly through the nib or will not flow by capillary attraction. Large pores tend to reduce the firmness of the nib. It is necessary to select a pore size particularly suited for the coating material used.

To provide the capillary action desired, it has been found that the cell size should be from 0.4 to 2 microns with particles having an average diameter of from 0.4 to 1 micron and a frequency of from 12 to 25 cells per linear cm. The preferred particles are those with an average size of 0.5 microns with cell sizes that range from 0.5 to 1.8 microns and an average frequency of from 20 to 22 cells per linear cm.

Another important aspect of the present applicator nib is the rigidity or firmness of the nib. The firmer the nib, the less it will compress under the forces or pressures applied during use. Because of the close tolerances between the particle sizes of the coating material and the pore openings of the nib, significant compression of the nib during use would close or reduce the size of the passages provided by the pores and restrict the flow of the particles. Additionally, any significant compression of the nib, when a corner is used to coat a narrow area or line, will cause the area of the nib in contact with the surface to be coated to be broader and harder to control. The nib must have sufficient firmness so that edges do not significantly deflect or compress when a pressure is applied. With the relatively firm nib of the invention, a corner may be used to form a narrow coating and/or form a coating on a curved surface area similar to that which can be formed by a pen.

The rigidity of the nib can be controlled by proper selection of materials and pore size and distribution. The nib of the present invention should not have a compression of greater than 20% with an applied pressure or force of 400 $gm/cm^2$. Preferably the compression should be less than 10%. Rather than just using an inherently rigid material, a flexible material with a permanent compression set can be used. As an example, the nib of the present invention can have a compression ratio of 10 to 20: 1 or can be compressed from 10 to 20 times its original volume. This means that the nib has a thickness or volume reduced to from 1/10th to 1/20th of its original volume to provide the desired rigidity. The preferred nib has a compression ratio of from 14 to 18. That is, the nib has a permanent compression set that is from 1/14th to 1/18th its original volume.

One example of a specific foam that may be used is SIF Felt®, a trade name, manufactured by Foamex, a division of Knoll International Holdings, Inc., a corporation of Eddystone, Pa. The advantage of using SIF Felt® is that the pore size can be selected and controlled during the manufacturing process. The use of the SIF Felt® allows the selection of a pore size, tailored to the fluid or coating material to be applied to a surface, and the firmness of the nib. The material is a flexible, compressed urethane foam made from a reticulated polyester or polyether polyurethane open-pore foam. By selecting the amount or degree the original foam is compressed, the firmness of the resulting foam can be controlled. The firmness of an originally resilient material, from a compression and set of from 1½ to 20 times the original volume, results in a foam product that ranges from soft and flexible to rigid. Thus, it is possible to maximize the wicking capabilities of the nib and minimize the susceptibility of the nib to clogging while maintaining the firmness desired for the particular coating material and surface or area to be coated.

An acceptable porous foam nib with the desired characteristics was determined. To find the particle and cell size the nib was observed under an electron microscope and was mounted, vacuum sputtered with a thin film of gold, and then examined under a Broutman's Cambridge 360 Stereoscan SEM. The nib was photographed and the cell size measured using the line SEM images and measurement cursors. The preferred nib was shown to have 12 to 25 cells per linear centimeter with an average of from 20 to 23. The maximum number of cells per centimeter was about 25 and the minimum was about 10 with an average cell size of from 0.5 to 0.8 microns. As an example, a preferred white-out or white shoe polish, composed of acrylic copolymer D, hydroxy, alcohol, organic amine neutralizer, titanium dioxide pigment and water, with an average pigment size of about 0.5 microns was used.

With the average pigment size of about 0.5 micron and an average pore size of from 0.5 to 0.8 micron, it takes about 30 seconds for the coating material to travel through the nib from its distal end to its proximal end with a nib length of 0.75 cm. By reducing the nib length the same coating characteristics can be maintained with a reduced waiting time. Because of the rigidity and wear characteristics of the selected and preferred SIF Foam® material, a nib can be used repeatedly without noticeable wear or interference to coating material flow.

It is believed that the construction, operation and advantages of this device will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

I claim:

1. A porous nib dispenser for a fluid coating material comprising:

a porous nib for passage and metering of said coating material onto a surface;

a support for said porous nib;

a passageway within said support for said porous nib;

said porous nib being an open pore foam having an average number of pores from 12 to 25 per linear centimeter with the average pore size being from 0.4 to 2 microns and with said nib having a rigidity such that a pressure of 400 gm/cm$^2$ causes a compression of said nib of less than 20%.

2. A porous nib dispenser for a fluid coating material as described in claim 1 wherein:

said porous nib is a resilient reticulated foam that has been made firm by compressing it to less than 1/10th of its original uncompressed volume.

3. A porous nib dispenser for a fluid coating material as described in claim 1 wherein:

said porous nib is a compressed reticulated polyurethane open pore foam.

4. A porous nib dispenser for a fluid coating material as described in claim 1 wherein:

said porous nib is a reticulated polyurethane open pore foam compressed to less than 1/14th of its original uncompressed volume.

5. A porous nib dispenser for a fluid coating material as described in claim 1 wherein:

said porous nib has an average number of said pores of from 18 to 23 per linear cm and an average said pore size of from 0.5 to 1.8 microns.

6. A porous nib dispenser for a fluid coating material as described in claim 5 wherein:

said porous nib is a reticulated polyurethane open pore foam compressed to less than 1/14th of its original uncompressed volume and has a rigidity such that a pressure of 400 gm/cm$^2$ causes a compression of less than 10%.

7. A porous nib dispenser for a fluid coating material as described in claim 1 wherein:

said porous nib has a cross-sectional area of from 0.1 to 1 cm$^2$ and has a length of from 0.5 to 3 cm.

8. A porous nib dispenser for a fluid coating material as described in claim 1 wherein:

a sealing material is placed between said support and said porous nib to prevent unwanted leakage of said coating material.

9. A porous nib dispenser for a fluid coating material as described in claim 1 wherein:

a resilient sheath is placed over a portion of said porous nib to prevent unwanted dispensing of said coating material and to seal said porous nib within said support.

10. A porous nib dispenser for a fluid coating material as described in claim 1 wherein:

a rigid sheath is placed over a portion of said porous nib to reinforce said porous nib.

11. A porous nib dispenser for a fluid coating material as described in claim 6 wherein:

a rigid sheath is placed over a portion of said porous nib to reinforce said porous nib;

said porous nib has a cross-sectional area from 0.004 to 0.5 cm$^2$.

12. A porous nib dispenser for a fluid coating material in combination with a fluid coating material comprising:

a porous nib for passage and metering of said coating material onto a surface;

a support for said porous nib;

a passageway within said support for said porous nib;

said porous nib being an open pore foam having an average number of pores from 12 to 25 per linear centimeter with the average pore size being from 0.4 to 2 microns and with said nib having a rigidity such that a pressure of 400 gm/cm$^2$ causes a compression of said nib of less than 20%;

a reservoir within said dispenser;

said reservoir being attached to said support for conducting said coating material to said passageway and through said porous nib within said passageway;

fluid coating material disposed within said reservoir;

said coating material being a fluid that contains solid pigments that have an average particle size between 0.4 and 1 micron.

13. A porous nib dispenser for a fluid coating material as described in claim 12 in combination with a fluid wherein:

said coating material consists of an acrylic copolymer D, hydroxy, alcohol, organic amine neutralizer, titanium dioxide pigments and water.

14. A porous nib dispenser for a fluid coating material as described in claim 13 in combination with a fluid wherein:

said average particle size is between 0.4 and 0.8 microns;

said nib is a resilient reticulated foam that has been made firm by compressing it to less than 1/10th of its original uncompressed volume;

said nib has an average number of said pores from 18 to 23 per linear cm and an average said pore size of from 0.5 to 1.8 microns.

15. A porous nib dispenser for a fluid coating material as described in claim 12 in combination with a fluid wherein:

said average particle size is 0.5 microns and said average pore size is from 0.5 to 0.8 microns.

16. A porous nib dispenser for a fluid coating material as described in claim 15 in combination with a fluid wherein:

said coating material consists of an acrylic copolymer D, hydroxy, alcohol, organic amine neutralizer, titanium dioxide pigments and water.

17. A porous nib dispenser for a fluid coating material as described in claim 16 in combination with a fluid wherein:

said porous nib has a cross sectional area from 0.004 to 0.5 $cm^2$;

said porous nib has a length of from 0.5 to 3.0 cm.

18. A porous nib dispenser for a fluid coating material as described in claim 13 in combination with a fluid wherein:

said nib is a reticulated polyurethane open pore foam compressed to less than 1/14th of its original uncompressed volume;

said nib has an average number of said pores from 18 to 23 per linear cm and an average said pore size of from 0.5 to 1.8 microns;

said nib has a cross-sectional area of from 0.1 to 1.0 $cm^2$.

19. A porous nib dispenser for a fluid coating material as described in claim 12 wherein:

a resilient sheath is placed over a portion of said porous nib to prevent unwanted dispensing of said coating material and to seal said porous nib within said support.

20. A porous nib dispenser for a fluid coating material as described in claim 12 wherein:

a rigid sheath is placed over a portion of said porous nib to reinforce said porous nib.

* * * * *